United States Patent [19]

König et al.

[11] Patent Number: 5,021,097

[45] Date of Patent: Jun. 4, 1991

[54] METHOD AND APPARATUS FOR CLEANING WINDOW FURNISHINGS

[76] Inventors: Reinhard König; Friedrich König, both of Mahlbergweg 5, 7505 Ettlingen, Fed. Rep. of Germany

[21] Appl. No.: 386,419

[22] Filed: Jul. 27, 1989

[30] Foreign Application Priority Data

Jul. 28, 1988 [DE] Fed. Rep. of Germany ..... 3825622

[51] Int. Cl.[5] ..... B08B 11/00

[52] U.S. Cl. ..... 134/25.5; 134/25.1; 134/29; 134/40; 134/129; 134/137; 134/188; 15/77; 15/102

[58] Field of Search ..... 134/26, 10, 25.1, 25.5, 134/29, 31, 39, 40, 37, 129, 188, 137; 160/107; 15/302, 303, 306 R, 103, 102, 77

[56] References Cited

U.S. PATENT DOCUMENTS 4,336,816 6/1988 Horz et al. ..... 134/88

4,817,646 4/1989 Brooks ..... 134/29

*Primary Examiner*—Asok Pal

*Attorney, Agent, or Firm*—Max Fogiel

[57] ABSTRACT

In a method of cleaning window furnishing portions such as curtain slats, the window furnishing material to be cleaned is left in the installed condition of hanging on a runner rail or track, pushed together to form a block. Washing-action medium and thereafter rinsing liquid are circulated from above over the window furnishing material which is then dried after the rinsing operation. The apparatus includes a washing device adapted to be hung on the runner rail and has a casing which in use encloses the window furnishing material. A nozzle assembly of the device is thus disposed above the window furnishing material, for washing-action medium and rinsing liquid to be pumped over same, and a receiving trough is arranged below the material to receive the liquid therefrom.

10 Claims, 3 Drawing Sheets

METHOD AND APPARATUS FOR CLEANING WINDOW FURNISHINGS

BACKGROUND OF THE INVENTION

The present invention relates generally to a method of cleaning window furnishings which are used in particular for decorating window, and an apparatus for carrying out such a method.

In this specification the term window furnishing is used to denote a curtain, a blind, a drape, an internal shutter arrangement and the like, and the term window furnishing portion is used to denote a piece of curtain or drape, a slat of a blind or shutter arrangement, and the like.

Window furnishings which are used for example for the purposes of decorating windows become soiled in the course of time and therefore desirably have to be cleaned at certain intervals. Particularly in the case of slat-like portions of curtains, drapes, blinds and the like, the cleaning operation is found to involve a considerable amount of time and work, and also considerable inconvenience, insofar as the soiled slats or pieces of fabric have to be removed from the window, cleaned piece by piece by washing and brushing and then reinstalled.

Besides the considerable amount of work and time involved in that operation, it has also been found that, after the cleaning operation has been carried out, there may be differences in length between the window furnishing portions after they have been fitted into position again. Obviously, such variations in length can have a major adverse effect on the intended decorative character of a window furnishing of that kind. To avoid that situation arising, soiled window furnishing portions are in many cases simply replaced by new window furnishing portions, although, as will be appreciated, that is often extremely expensive.

SUMMARY OF THE INVENTION

An object of the present invention is to provide a method of cleaning window furnishings which does not suffer from the above-discussed disadvantages.

Another object of the present invention is to provide a method of cleaning window furnishings with which the window furnishings can be quickly and easily cleaned under the same physical conditions applying to the whole of the window furnishing portions involved.

Still another object of the present invention is to provide a method of cleaning window furnishings which does not involve removal of the window furnishings from the installed position, while however not giving rise to serious untidiness and mess in the cleaning operation.

Yet another object of the present invention is to provide an apparatus for cleaning window furnishings, which is quick and simple to use while providing a reliable and tidy cleaning effect.

In accordance with an aspect of the present invention these and other objects are achieved by a method of cleaning window furnishings wherein, in a first step, the window furnishing to be cleaned, while still in the position of installation thereof, is pushed together to form a block, hanging on a runner rail supporting the window furnishing, in a second step washing-action medium is circulated from above over the window furnishing in its pushed-together condition, in a third step rinsing liquid is circulated from above over the window furnishing, and in a fourth step the window furnishing is dried.

It will be seen therefore that, with that mode of operation, the window furnishing portions to be cleaned do not need to be taken down from the window for the purposes of cleaning same, and then rehung after the cleaning operation, but remain in their normal position of installation in which they are suspended from a runner rail, track or the like. It will be seen that that means that the cleaning method can be carried out quickly and inexpensively while in addition all the parts of the furnishing material to be cleaned are sutjected to the same physical conditions during the cleaning procedure.

In accordance with a preferred feature of the invention the window furnishing is subjected to the drying operation in a freehanging condition. Alternatively, the window furnishing can be dried in the pushed-together condition of constituting a block configuration, insofar as rinsing liquid which is still contained in the window furnishing drips away under the effect of the force of gravity. In that phase it has been found desirable for the window furnishing to be dried to be clamped between clamping bars and thereby held in the correct form.

In another aspect of the present invention there is provided an apparatus for cleaning window furnishing portions, comprising a washing device which can be suspended on a runner rail, track member or the like carrying the window furnishing to be cleaned. The washing device essentially comprises an abutment means for fixing a required position on the runner rail, track or the like, a nozzle assembly, a casing means extending downwardly from the nozzle assembly and in use of the apparatus enclosing the window furnishing to be cleaned in a tubular configuration, and a collecting trough at the lower end of the casing means.

In an advantageous feature of the apparatus according to the invention the abutment and the nozzle assembly may be enclosed by a frame which in turn carries the casing means enclosing the window furnishing to be cleaned.

The abutment and the nozzle assembly may also have clamping elements which permit the window furnishing which is guided in a hanging condition on the runner rail, track or the like, to be held in the condition of being pushed together for the cleaning operation.

In a preferred feature of the invention the spacing between the nozzle assembly and the collecting trough means is adjustable for the purposes of permitting adaptation of the apparatus to different lengths of the window furnishing to be cleaned. In a preferred embodiment of the apparatus, the collecting trough means into which the casing means which encloses the window furnishing to be cleaned should project may be connected by way of adjustable support means to the frame enclosing the nozzle assembly and the abutment.

In another embodiment of the apparatus according to the invention, between the collecting trough means and a pump for selectively delivering washing-action medium or rinsing liquid, at the lowest point in the circuit thereof, is an auxiliary vessel which is of larger capacity than the containers for storing and supplying the washing-action medium and the rinsing liquid respectively, wherein the auxiliary vessel can be selectively connected to respective ones of said containers so that the entire supply of washing-action medium on the one hand and the entire supply of rinsing liquid on the other hand can be selectively introduced into the auxiliary vessel in operation of the apparatus.

The apparatus may advantageously include a suitable conduit system, associated valves and a pump, to provide that washing-action medium and then rinsing liquid such as water can be successively circulated from above over the window furnishing material to be cleaned.

In normal use of the apparatus the auxiliary vessel referred to above stands on the floor and the associated storage and supply containers thereof are arranged at such a level that the content thereof can always drain off into the auxiliary vessel when the appropriate valve is in the appropriate position. For the purposes of emptying the content of the auxiliary vessel back into the respective storage and supply container, the auxiliary vessel can then be lifted to a higher level than the respective container.

Desirably, the apparatus may include a carriage or truck for carrying the operating units of the apparatus such as the above-mentioned storage and supply containers, conduits, valves, pump, possibly a heating means, and the above-mentioned auxiliary vessel. That therefore provides a mobile apparatus which is easy to handle for the cleaning operation concerned.

Further objects, features and advantages of the present invention will be apparent from the folLowing description of a preferred embodiment of the invention.

DESCRIPTION OF THE PREFERRED EMBODIMENT

Figure 1:
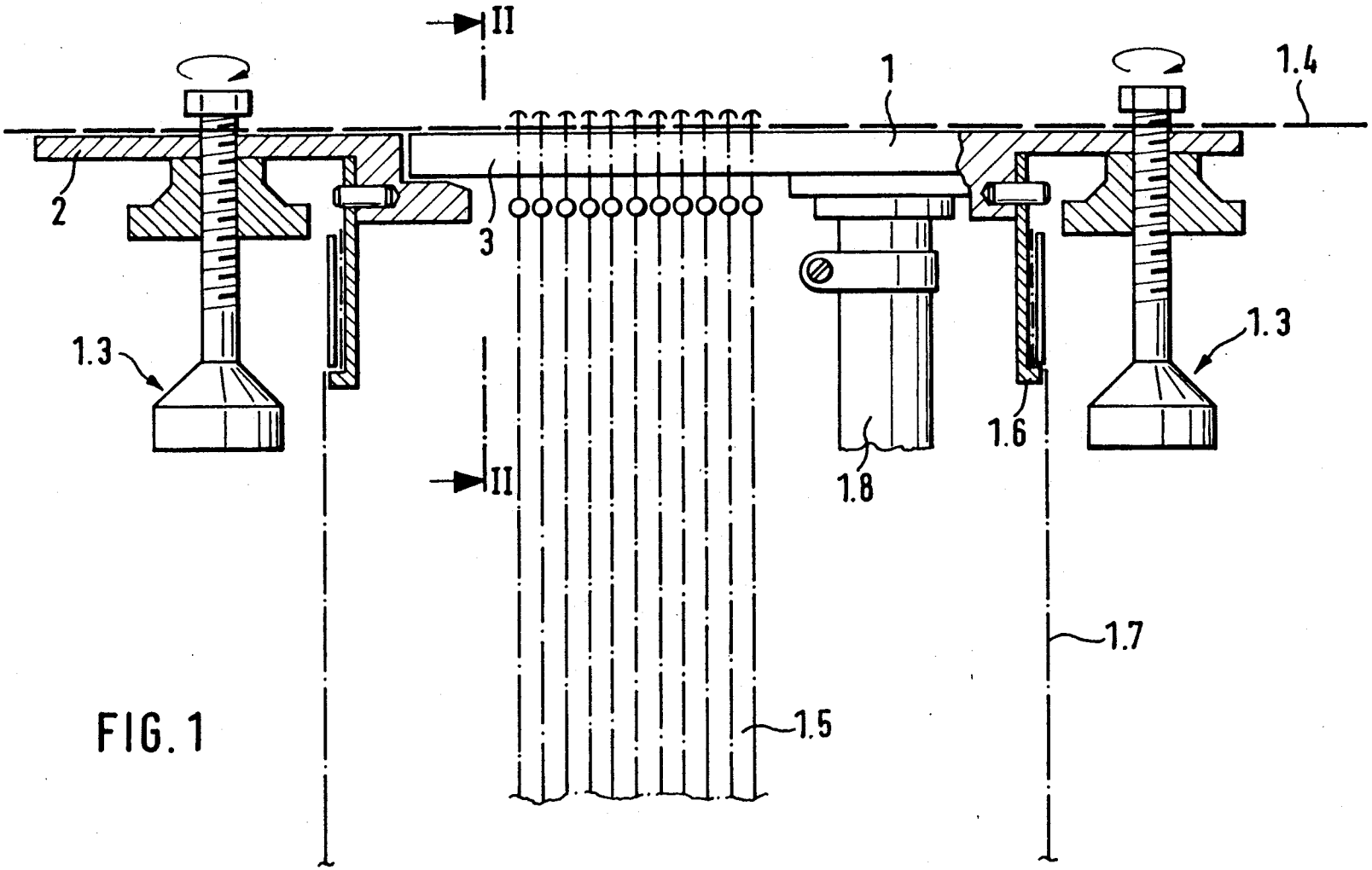
FIG. 1 is a sectional side view of part of the apparatus according to the invention, comprising the washing device which is suspended on a window furnishing runner rail, track or the like, and window furnishing portions such as slat members which are pushed together to form a block configuration.
Figure 2:
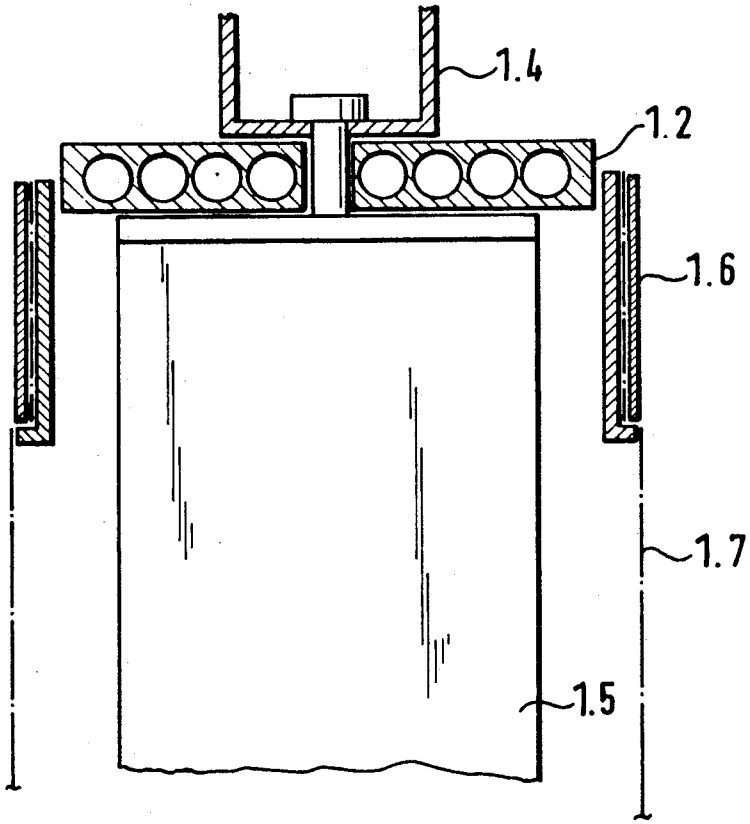
FIG. 2 is a view of the washing device in section taken along line A—A in FIG. 1.

Referring firstly to FIG. 1, shown therein is part of the washing apparatus according to the invention, comprising a washing device which is indicated generally by reference numeral 1. The washing device 1 comprises an abutment indicated at 1.1 and a nozzle assembly which is indicated more clearly at 1.2 in FIG. 2. The abutment 1.1 and the nozzle assembly 1.2 are releasably connected by means of clamping elements 1.3 in the form of screws with lock nuts thereon, to a runner rail or track member 1.4 which supports the window furnishing portions in such a way that they hang downwardly therefrom, being slidable thereon. In the view shown in FIG. 1 the window furnishing portions have been pushed together to form a block configuration indicated at 1.5.

The abutment 1.1 and the nozzle assembly 1.2 are surrounded by a frame structure 1.6 to which is fixed a casing means 1.7 which extends downwardly from the frame structure 1.6 and which encloses the block configuration 1.5, in a generally tubular configuration. Reference numeral 1.8 in FIG. 1 diagrammatically indicates a feed conduit by way of which the nozzle assembly 1.2 can be alternatively supplied with washing-action medium and with rinsing liquid.

Figure 3:
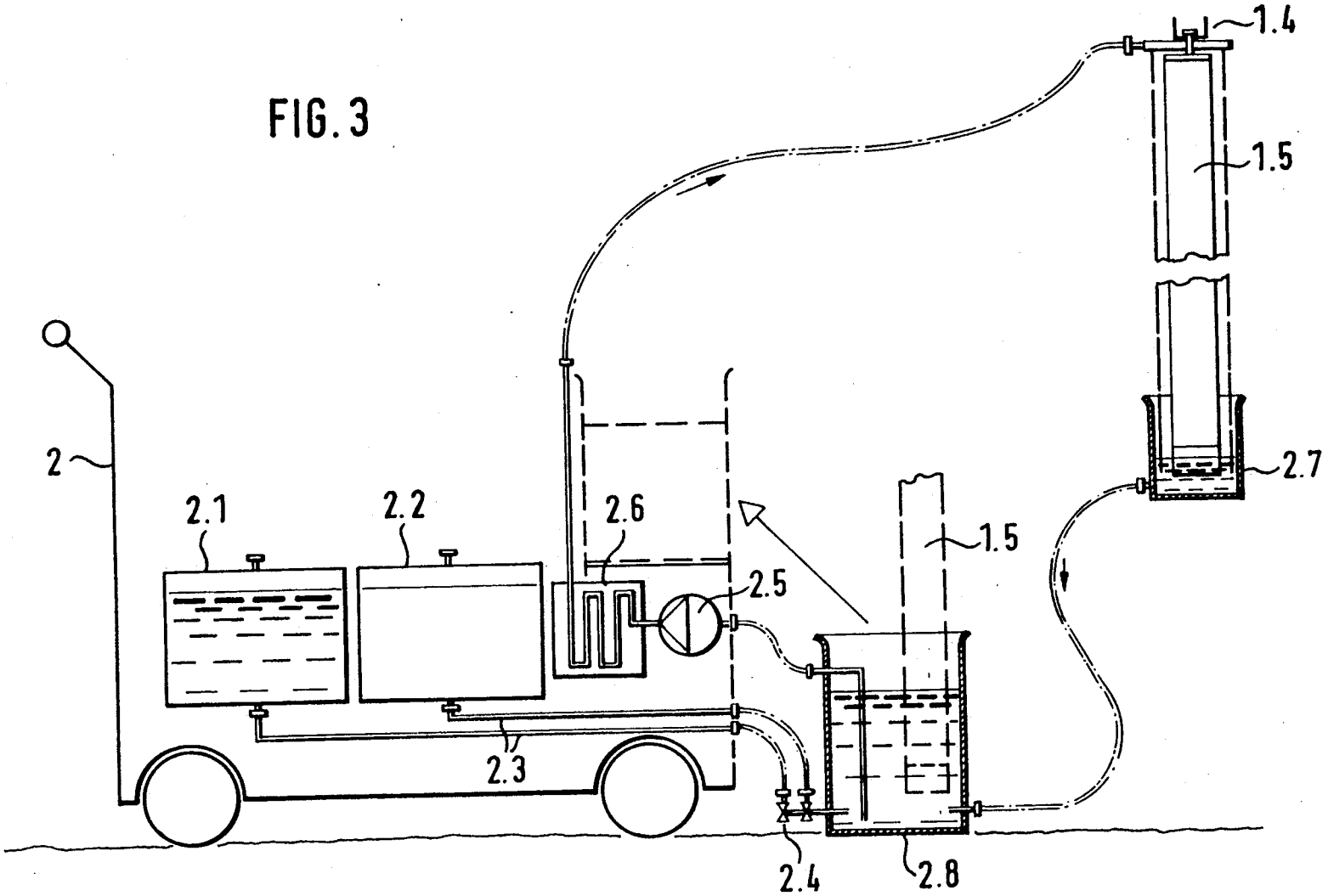
FIG. 3 is a diagrammatic overall view of the washing apparatus comprising the washing device to be suspended on the window furnishing runner rail, track or the like, and a carriage or truck carrying auxiliary units of the apparatus, in the position of use of the apparatus.

As shown in FIG. 3, the washing apparatus of the present invention also includes a collecting vessel in the form of a collecting trough 2.7 into which the lower end of the casing means 1.7 around the block configuration 1.5 extends.

Referring to FIG. 3, shown therein is a carriage or truck 2 which carries a storage and supply container 2.1 for washing-action medium and a further storage and supply container 2.2 for a rinsing liquid such as water. The containers 2.1 and 2.2 are connected by way of conduits 2.3 and valves 2.4 to an auxiliary vessel 2.8 which can be placed on the ground in the condition of use of the washing apparatus of the invention. The auxiliary vessel 2.8 can be selectively filled with washing-action medium from the container 2.1 or rinsing liquid from the container 2.2. Projecting into the auxiliary vessel 2.8 is a suction intake conduit which is in fluid communication with a pump 2.5 carried on the truck 2. The conduit 1.8 which goes to the nozzle assembly 1.2 is connected to the delivery side of the pump 2.5, to supply the washing-action medium or the rinsing liquid to the nozzle assembly 1.2. The liquid delivered by the pump 2.5 passes through a heating means indicated diagrammatically at 2.6 before being passed to the nozzle assembly 1.2.

Having described the structure of the apparatus according to the invention, the mode of operation thereof is as follows:

In normal use of the washing apparatus, the washing device 1 is firstly suspended on the runner rail or track member 1.4, in the above-indicated fashion, in the appropriate fixed position thereon. The nozzle assembly 1.2 then extends over the window furnishing portions such as slat members which have been pushed together to form the block configuration 1.5, and the window furnishing portions are enclosed by the casing means 1.7. The casing means 1.7 hangs down from the frame 1.6 and extends at its lower end into the connecting vessel 2.7 with a drain conduit which carries liquid from the window furnishing portions back into the auxiliary vessel 2.8.

After those preparatory operations, the auxiliary vessel 2.8 is filled with washing-action medium from the storage and supply container 2.1 and then that medium is conveyed by means of the pump 2.5 to the nozzle assembly 1.2 in order then to run downwardly from above over the window furnishing portions making up the block configuration 1.5. The washing-action medium which drips off the bottom ends of the window furnishing portions in the casing means 1.7 and which is collected in the collecting trough 2.7 then flows back to the auxiliary vessel 2.8 and is then again passed in a circulatory fashion over the window furnishing portions, by means of the pump 2.5. When the cleaning operation is concluded after a specified washing time, then the washing-action medium is caused to flow from the auxiliary vessel 2.8 back into its associated container 2.1 and rinsing liquid is then passed into the auxiliary vessel 2.8 from the container 2.2. The rinsing liquid is then circulated over the block configuration 1.5 in the same fashion as described above.

Figure 4:
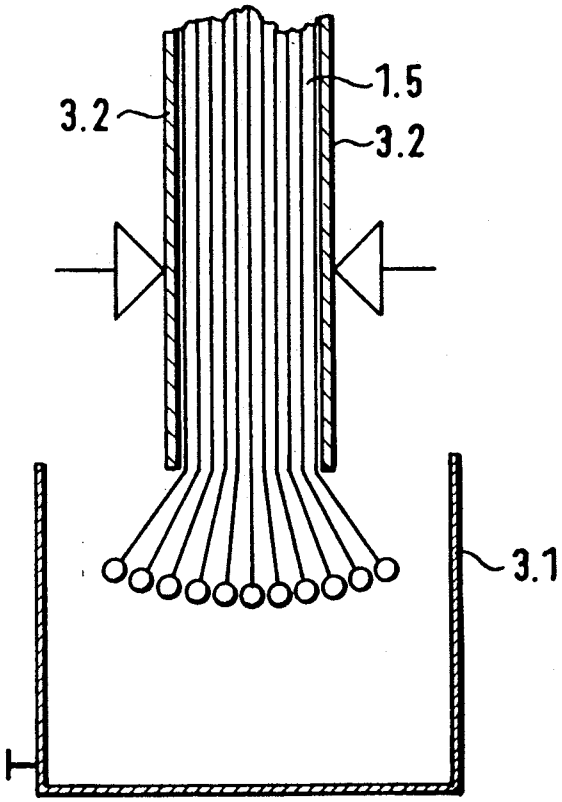
FIG. 4 is a view of the lower part of an array of window furnishing portions which are disposed between clamping bars, and a collecting trough which is arranged therebeneath.

After the rinsing operation the washing device 1 is removed. The block configuration 1.5 is then in a freehanging condition and liquid thereon and therein drips off into a drip collecting trough 3.1 (as shown in FIG. 4) which is arranged beneath the block configuration 1. The trough 3.1 may be for example suitably suspended on connecting chains (not shown) interconnecting the window furnishing portions or slat members. When dealing with types of window furnishing portions such as slat which are particularly sensitive in regard to retaining their shape, the block configuration can be disposed and dried between two lateral clamping bars which are indicated at 3.2 in FIG. 4, which keep them in their respective shape.

It will be seen therefore that the cleaning method which can be carried out by means of the above-described apparatus provides that the washing-action medium which is drawn from the auxiliary vessel 2.8 which stands on the ground, after the latter has been filled with the medium from the container 2.1, is circulated over the window furnishing to be cleaned, possibly being heated in the heating means 2.6 shown in FIG. 3. After the washing operation rinsing liquid is circulated from above in the same manner over the window furnishing material, followed by a drying step.

The method and apparatus in accordance with the invention provide that the cleaning operation can be carried out extremely quickly and all parts of the material to be cleaned are subjected to the cleaning effect under the same physical conditions. The setting times involved in setting up the apparatus are independent of the number and the area of the window furnishing portions to be cleaned and the fact that all window furnishing portions are treated in the same fashion means that there is a greatly reduced risk of variations in the lengths of the individual window furnishing portions.

It will be appreciated that the above-described method and apparatus in accordance with the principles of the present invention have been set forth solely by way of example and illustration thereof and that various modifications and alterations may be made therein without thereby departing from the spirit and scope of the invention.

I claim:

1. A method of cleaning window furnishings while located in their place of use, comprising: a first step of pushing together window furnishings to form a vertically hanging block configuration; a second step of circulating a washing medium from above and over the window furnishings; a third step of circulating rinsing liquid from above and over the window furnishings; a fourth step of drying said window furnishings; and a fifth step of collecting surplus fluids at a base of said window furnishing, all said steps being carried out while said window furnishings are hanging vertically in their locations of normal use on windows, so that the window furnishings are not removed from the windows for cleaning; said washing medium and said rinsing liquid flowing downward from above due to gravity and covering said window furnishings uniformly while flowing downward with uniform velocity.

2. A method as defined in claim 1, wherein said window furnishings are dried in a free-hanging condition.

3. A method as defined in claim 1, including the step of holding said window furnishings between clamping members while being dried.

4. An arrangement for cleaning window furnishings while located in their place of use, comprising: support means from which said window furnishings hang; washing means hung on said support means and comprising an abutment for defining a position of said washing means on said support means; nozzle means for passing liquid over said window furnishings; casing means extending downwardly from said nozzle means to enclose the window furnishings in a tubular configuration; said washing means supplying washing medium from above and over the window furnishings; means for circulating rinsing liquid from above and over the window furnishings; means for drying said window furnishings; and means for collecting surplus fluids at a base of said window furnishings, said window furnishings being cleaned while handling in their locations of normal use on windows, so that the window furnishings are not removed from the windows for the cleaning.

5. An arrangement as defined in claim 4, wherein spacing between said nozzle means and said collecting means is adjustable dependent on length of said window furnishings.

6. An arrangement as defined in claim 4, including respective storage containers for containing a washing medium and a rinsing liquid; an auxiliary vessel with capacity larger than said storage containers; means for connecting selectively said respective storage containers to said auxiliary vessel; and pump means for selectively delivering washing medium or rinsing liquid from said auxiliary vessel, said pump means being located at a lowest point of a flow line to said nozzle means.

7. An arrangement as defined in claim 6, wherein said auxiliary vessel is liftable to a level above said storage containers for emptying said auxiliary vessel into said storage containers.

8. An arrangement as defined in claim 4, including auxiliary units comprising storage containers for holding washing medium and rinsing liquid, pump means for pumping said washing medium and said rinsing liquid, heating means for heating said medium and said liquid, an auxiliary vessel for receiving said washing medium and said rinsing liquid selectively from respective ones of said containers, conduit means and value means for interconnecting said containers and said vessel; and carriage means for carrying said auxiliary units.

9. An arrangement for cleaning window furnishings while located in their place of use, comprising: supporting means from which said window furnishings hang; a spray head mounted on said support means above said window furnishings; casing means extending downward from said spray head when in use for enclosing said window furnishings within said casing means; first container means for containing a washing medium; second container means for containing a rinsing liquid; pump means for pumping said medium and said liquid selectively through said spray head downwardly over said window furnishings; and conduit means and value means for connecting selectively respective ones of said containers, said pump and said spray head, said window furnishings being cleaned while hanging in their locations of normal use on windows, so that the window furnishings are not removed from the windows for cleaning.

10. An arrangement for cleaning window furnishings while located in their place of use, comprising: support means from which said window furnishings hang; washing means hung on said support means and comprising an abutment for defining a position of said washing means on said support means; nozzle means for passing liquid over said window furnishings; casing means extending downwardly from said nozzle means to enclose the window furnishings in a tubular configuration; said washing means supplying washing medium from above and over the window furnishings; means for circulating rinsing liquid from above and over the window furnishings; means for drying said window furnishings; and means for collecting surplus fluids at a base of said window furnishings, said window furnishings being cleaned while handing in their locations of normal use on windows, so that the window furnishings are not removed from the windows for cleaning; spacing between said nozzle means and said collecting means being adjustable dependent on length of said window furnishings; respective storage containers for holding washing medium and rinsing liquid; an auxiliary vessel having a capacity larger than said storage containers; means for selectively connecting said respective storage containers to said auxiliary vessel; pump means for selectively delivering washing medium or rinsing liquid from said auxiliary vessel, said auxiliary vessel being located at a lowest point of a flow line to said nozzle means; said auxiliary vessel being liftable to a level above said storage containers for emptying said auxiliary vessel into said storage containers.

* * * * *